United States Patent [19]

Huvey et al.

[11] Patent Number: 4,932,352

[45] Date of Patent: Jun. 12, 1990

[54] METHOD AND DEVICE FOR IMPREGNATING AN ELONGATE ELEMENT

[75] Inventors: Michel Huvey, Bougival; Lucien Montabord, Cormeilles en Parisis, both of France

[73] Assignee: Institut Francais du Petrole, Rueil Malmaison, France

[21] Appl. No.: 165,603

[22] Filed: Mar. 8, 1988

[30] Foreign Application Priority Data

Mar. 9, 1987 [FR] France ..... 87 03295

[51] Int. Cl.[5] ..... B05C 1/08

[52] U.S. Cl. ..... 118/202; 427/428

[58] Field of Search ..... 118/202, 246; 427/428

[56] References Cited

U.S. PATENT DOCUMENTS 3,682,133 8/1972 Gomarin et al. ..... 118/202

3,788,271 1/1974 Carpenter et al. ..... 118/202 X 3,818,860 6/1974 Rebentisch ..... 118/202

*Primary Examiner*—Shrive Beck

*Assistant Examiner*—Alain Bashore

*Attorney, Agent, or Firm*—Antonelli, Terry & Wands

[57] ABSTRACT

The invention provides a method and device for impregnating at least one elongate element by transferring a thermostabilizable substance from a supply station by means of a supply means, the element being moved in front of the transfer means which includes a mobile surface passing in front of the station then in front of the element, the substance being deposited on the surface in said station and being transferred therefrom at least partially onto the element in a zone close thereto, wherein the transfer means includes thermoregulation means such as heating means, adapted so that the temperature at the surface in the impregnation zone is substantially higher than that of the substance in said supply station.

7 Claims, 1 Drawing Sheet

METHOD AND DEVICE FOR IMPREGNATING AN ELONGATE ELEMENT

BACKGROUND OF THE INVENTION

The invention relates to a device and method for impregnating elongate elements with a thermostabilizable substance.

More particularly, the present invention provides an improvement to the device and method for impregnating elongate elements, such as threads or resistant fabrics, reinforced by means of a thermosetting substance, such as a thermosetting liquid resin.

By thermostabilizable substance is meant all substances whose characteristics are durably and permanently modifed under the action of heat and/or temperature.

This thermal action may the sole action responsable for the process of modification of the characteristics of the substance, as may occur during cross linking or vulcanization of the material. This thermal action may also be not the only action to produce durable or permanent modifications of the material, but may act concurrently with other actions, such as oxidation or evaporation of the material, or of a part thereof.

The thermostabilizable substances which may be used by the invention are preferably, but not necessarily, fluid at the different temperatures imposed on the substance in the device, or following the method, of the invention. These substances may for example be thermosetting materials, elastomers, thermoplastics or metals.

The elongate element may be elongate reinforcement elements, such as reinforcing threads made from metal, polyamide, KEVLAR which is a polyaramide whose trademark is registered by the firm Dupont de Nemours, glass, carbon, disposed in layers of parallel threads, braids or fabrics.

In the prior art, when it is desired to impregnate elongate elements, a tank is used having heat regulation means, for example heating means, in which the impregnation substance is disposed and into which penetrates a drum transferring the substance to the zone for impregnation of the elongate elements. A radiating panel generally provides complementary heating of the substance at the impregnation zone level.

Relatively to the prior art, the present invention makes it possible to improve the impregnation quality of the elongate elements, particularly in so far as the deeper penetration of the substance and reduction of air bubble inclusions are concerned, to increase the production rate and finally to considerably restrict material waste, in particular of the thermostabilizable substance.

Moreover, the device and method of the present invention make it possible in numerous cases to reduce and even to omit the addition of solvent to the thermostabilizable substances.

So the present invention, by omitting the addition of solvent, makes it possible to get out solvent elimination means which are generally used upstream the impregnation device according to the prior art.

The flexibility of implementation of the present invention makes it possible to insert the proposed device in a continuous or discontinuous production line, particularly when stoppages thereof are possible.

SUMMARY OF THE INVENTION

Simply stated, the device and method of the invention consist more particularly, at the time of impregnation, in improving the characteristics of the impregnation substance, in particular in reducing its viscosity by a temperature rise, using circumscribed heating, while maintaining the substance waiting to be used at a lower temperature.

Depending on the substances which may be used in the impregnation device of the invention, the temperatures of the substance at the time of impregnation, or waiting to be used, may be either greater or less than the ambient temperature, or one greater and the other lower. For that, the means such as heating or cooling means used for maintaining a temperature difference will generally be defined as thermoregulation means.

The invention overcomes the drawbacks of the prior art which uses a much lower and often very insufficient impregnation temperature, and results in clogging of the transfer means and of the supply station, a rapid evolution of the substance waiting to be used and considerable waste of substance.

The invention provides a device for impregnating an elongate element by transferring a thermostabilizable substance from a station supplying the substance as far as the element by means of a transfer member, the element being moved longitudinally in front of the transfer means said transfer means including a mobile surface passing through the station then in front of the element, the substance being deposited on the surface at the level of the station while being transferred at least partially onto the element, in a zone adjacent said element. In the device of the invention, the transfer means comprise more particularly thermoregulation means such as heating means, adapted so that the temperature at the surface at the level of the impregnation zone is substantially higher than that of the substance in the station.

The supply station may comprise thermoregulation means adapted so that the temperature of the substance in the station is substantially lower than the temperature at the surface at the level of the impregnation zone.

The device may comprise a squeegee means adapted for removing from the surface the substance not transferred by the element, this squeegee means being situated upstream of said supply station.

The device may comprise a dosing element placed downstream of the supply station, this dosing element being adapted so as to produce, on the surface, a layer of substance which is uniform and adjusted in thickness.

The device may comprise at least one system, such as a roller, for preparing the element to be impregnated, upstream of the zone where the element is impregnated.

The device may include means for separating the elongate element from the transfer means and the transfer means may include safety drive means adapted for moving the transfer means once the separation means have been brought into action.

A part of said elongate element may be applied against a part of said transfer means, and the reinforcing element may drive said transfer means.

The thermostabilizable substance may be a thermosetting resin.

The transfer means may comprise at least one cylinder of revolution.

The supply station may comprise a tank in which said substance is situated and the transfer means may plunge into said tank.

The supply station may comprise a tank in which said substance is contained, and a circulating member adapted for picking up said substance situated in said tank, conveying it towards said transfer means and correctly coating this latter therewith.

The device may comprise spacing means adapted for moving the transfer means away from the supply station.

The invention also provides a method of impregnating a reinforcement element by transferring a thermostabilizable substance from a station supplying the substance as far as said element to be impregnated using a transfer means having a mobile surface on which said substance is deposited. In this method, in particular, the temperature of the surface is maintained substantially above that of the station.

BRIEF DESCRIPTION OF THE DRAWINGS

The present invention will be better understood and its advantages will be clear from reading the following description relating, but not exclusively, to the impregnation of elongate reinforcing elements by means of a thermosetting substance and illustrated by the accompanying drawings illustrating two possible embodiments of the device of the invention wherein.

DESCRIPTION OF THE PREFERRED EMBODIMENTS

Figure 1:
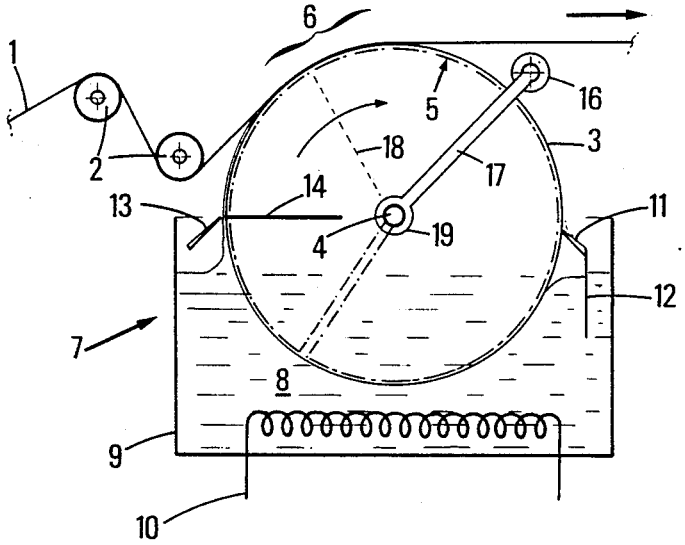
FIG. 1 is a schematic elevational view of one embodiment of the device of the invention wherein a transfer means in the form of a cylinder is employed to impregnate an elongate element.

In this FIG. 1, the elongate element 1 is for example formed of an assembly of one or more reinforcing filament rovings placed parallel along their longitudinal axis and substantially in the same plane. This elongate element 1 bears on two preparing or opening rollers 2, whose diameters, spacing and transverse arrangement are adapted to the nature and dimensions of the rovings so as to cause if required breakage of the binder which agglomerates the reinforcement threads and thus to allow opening of the rovings.

After passing through the zone of the preparing rollers, which may be limited to a single one, the elongate element 1 is first of all applied on the transfer means 3 so as to undergo impregnation with a given amount of thermosetting substance, then moves away from said transfer means 3 for spooling or to be used directly, for example, for the continuous manufacture of composite material weaves, particularly, the weaves forming part of the reinforced tube, or for manufacturing a tube or an object by filament winding.

In FIG. 1, the elongate element 1 is applied on the transfer means 3 but it could also not be applied thereon and pass close by, the transfer of material being provided by centrifugal, electrostatic or fluid projection, for example. However, the configuration described is simple and very efficient.

The transfer means 3 include a cylindrical drum of circular section which rotates about an axis 4 and is driven by means of the elongate element 1, whose drive is obligatory. The drum of the transfer means 3 could also be motorized, but experience shows that a reduced number of rovings in contact with a reduced portion of the drum does away with the need for a specific motor.

The transfer means 3 could also comprise a flexible transport belt mounted on rollers.

In the vicinity of its mobile external surface coming into contact with the elongate element, the inside of the transfer means 3 is provided with heating means 5, by electric resistance, hot air or heat carrying fluid, etc, adapted for maintaining a high temperature so that the substance, which behaves at this temperature like a fluid, has its lowest possible viscosity and impregnates the elongate element 1 in depth, without inclusion of air, sufficiently and without excess substance.

Tests made with a transfer means 3 of 50 cm wide and 30 cm in diameter and with a thermosetting resin as impregnation substance, show that depending on the production speed, the temperature at the surface of the transfer means at the level of the impregnation zone may for example be between 70° and 140° C. depending on the speed impregnation of the elongate element and the temperature of the supply station 7 between 7° and 25° C. depending on the temperature of the water used for cooling.

For these tests, the thermosetting resin was formed of a 100 parts of bisphenol A diglycidylether (base), 90 parts of acid internal anhydride 2.3, dicarboxylic, 1.5 norbonene, X methyl (hardener) and parts of benzyldimethylamine (accelerator).

Generally, the temperature of the supply station 7 is adapted so as to limit the chemical evolution of the substance contained in the supply station and to ensure the suitable supply of the transfer means 3.

Similarly, the temperature of the transfer means 3 is adapted so that the viscosity of the impregnation substance is the lowest necessary at the level of the impregnation zone so as to allow correct impregnation of the elongate elements 1 and so the chemical evolution of the substance on the transfer means is minimum.

For example, a thermosetting resin must remain fusible or molten in the device.

Whereas the zone 6 for impregnation of the elongate element 1 is situated in the upper part of the transfer means 3 station 7 supplying the thermosetting substance 8 is situated in the lower part of said means 3, so that the supply station may advantageously comprise a tank 9 containing the substance 8.

To avoid overheating of the substance 8 contained in tank 9 because of the heating of the transfer means 3, the tank 9 includes cooling means 10, such as a current water cooling coil, or an exchanger connected to a cooling unit or else cooling fins placed in a forced air flow.

Overheating of tank 9 is due to the heat coming from the transfer means 3, either directly by contact with substance 8, or by the substance which was deposited on the transfer means 3 at the level of the supply station 7, and which has not been removed during impregnation of the elongate element 1 which is removed from the surface of the transfer means 3, either after impregnation and upstream of the supply station 7, by means of a squeegee means 11 or downstream of the supply station by scrapers 14.

Upstream of a point considered is the zone which the material element passes through during the technical process before reaching the point considered, whereas on the contrary downstream is the zone which is reached after the point considered.

Cooling makes it possible to maintain the supply station 7 for example at a temperature of 20° C., so as to slow down gelling of the resin or generally the evolution of the impregnation substance.

The substance removed by the squeegee 11 is fed back into a cold zone of tank 9 by means of a separating wall 12, so as to stop the evolution of the substance removed as quickly as possible. However, the substance removed may also be fed back by distributing it in the vicinity of the transfer means 3, so that the substance is rapidly consumed by impregnation.

This process avoids stagnation of the substance on parts of the surface of the transfer means 3 which are not free of substance following impregnation of the elongate element 1.

Removal of the heated substance, mixing it with the fresh substance contained in tank 9, then distribution of the mixture over the heat surface of the transfer means leads more particularly to the saving of energy by preventing the heated substance from being cooled before being heated again a number of times. However, this rapid recycling is achieved to the detriment of a hardening effect which attenuates the evolution of the substance.

With this squeegee means 11, any stagnation is avoided of hot substance, such as resin, turning round and round between the rovings with the risk of gelling the surface of the transfer means.

Downstream of the supply station 7 is disposed a dosing element 13 for making the layer of substance uniform and adjusting it in thickness, whose transfer means 3 is covered when passing through the supply station 7. The excess substance then comes back to station 7.

The thickness of the layer is adjusted so that the rovings forming the elongate element 1 are correctly impregnated (neither too little nor too much).

Substantially at the same level as the dosing element, on each of the sides of the transfer means 3, two scrapers 14 are provided for removing the substance from the sides and then transferring this substance to a cooled zone of tank 9.

The supply tank 9 may conform to the geometry of the transfer means 3 so as to reduce the amount of substance contained in the tank and reheated by means 3. A thickness of substance between the bottom of tank 9 and means 3 from 5 to 30 mm is satisfactory. This arrangement however requires resupplying the tank with fresh resin more frequently than when the tank is larger.

By using adapted cooling means 10, or taking advantage of the poor heat conductivity of the substance, the volume of the tank may be increased.

During stoppage of the transfer member 3, in order to prevent the resin impregnating the elongate element 1, evolving under the action of the heat, the device includes separation means between the elongate element 1 and said means 3.

These means may be formed of a roller 16 actuated by a mobile arm 17 in the case of stoppage. With the roller initially situated between the rovings 1 and the transfer means 3, it then comes to occupy the position 18 shown with a broken line.

Similarly, when the production of impregnated rovings is stopped, the same means may be used for moving the rovings 1 away from the transfer means 3. In this case, a safety drive means 19 will maintain means 3 in rotation if it does not have its own motorization means.

With the device, very variable manufacturing rates may be obtained with a production of impregnated rovings of 0.2 m/min to 100 m/min and preferably from 2 m/min to 25 m/min, without any risk of gelling of the transfer means and of the supply station. In addition, the impregnation quality is improved by the good penetration of the resin into the elongate element.

The transfer means may also be motorized and cause the elongate element to travel in a direction opposite that of said means.

Figure 2:
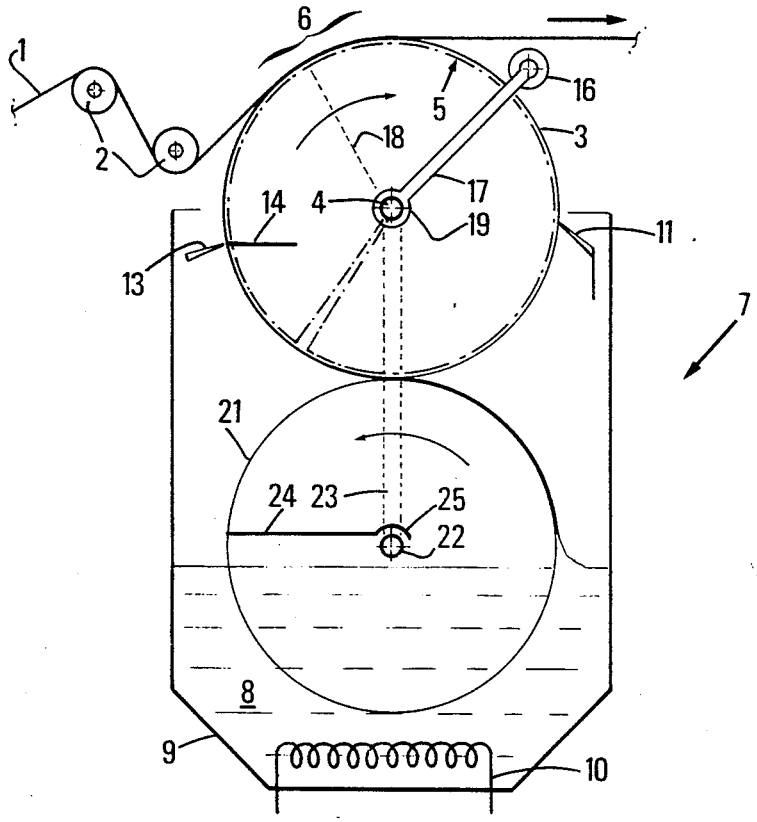
FIG. 2 is a schematic elevational view of another embodiment of the invention wherein a supply station includes a circulating member for conveying the impregnation substance to the transfer means contacting the elongated element to be impregnated.

FIG. 2 illustrates the variant of the embodiment of the invention illustrated in FIG. 1. The similar elements in FIGS. 1 and 2 are designated by the same references.

The difference between the embodiments of FIGS. 1 and 2 resides in the fact that the supply station 7 includes a circulating member 21 of cylindrical shape rotating about a fixed shaft 22 and picking up on its periphery the impregnation substance by plunging this member 21 into tank 9 filled with substance.

The substance picked up by the circulating member 21 is conveyed by rotation of member 21 to the transfer means 3 which is then coated therewith. The space between the transfer means 3 and the circulating member 21 is adapted so as to allow correct coating thereof.

A gear train (not shown), protected from possible splashes of the substance, provides synchronization between the transfer means 3 and the circulating member 21, so that the transfer means are correctly coated and the impregnation be correct. The height of the teeth of these gears may be such that the circulating member 21 may be driven when, through spacing means 23, the transfer means 3 and the circulating member 21 are spaced apart, for example for a stoppage of the advance of the elongate elements 1, once the separation means 16, 17 and the safety drive means 19 of the transfer means 3 have been brought into action. The spacing apart produced makes it possible to completely squeegee the transfer means 3 and to prevent the substance there located to undergo chemical evolution.

To ensure the correct drive of the circulating member 21, recourse may also be had to an additional motor placed at the level of shaft 22 and driving member 21.

The supply station comprises two scrapers 24 removing the impregnation substance from the sides of the circulating member 21. These scrapers are advantageously disposed just upstream of where the substance is picked up by member 21, so as to provide the best possible cooling thereof and renewal of the substance situated on its sides.

A protector 25 placed at the end of scraper 24 situated close to shaft 22 prevents resin splashes from hindering the rotation of member 21.

The squeegee means 11 of the transfer means 3, which in the preceding embodiment discharged the substance beyond a separating wall 12, lets the substance fall directly into tank 9.

Since, in the second embodiment, the sides of the transfer means 3 are covered with substance over a more restricted zone than in the first embodiment (FIG. 1), the length of scrapers 14 may be reduced.

In the first embodiment of the invention, a spacing member may also be used between the transfer means and the impregnation station, so as to be able to completely squeegee the transfer means 3.

For some types of products and impregnation conditions it is possible to add a radiating panel to the device, in the impregnation zone, so as to locally increase the temperature of the substance in order to improve impregnation of the rovings.

The transfer means may also be coated by melting a block of substance placed at a temperature sufficient for it to be solid. The substance removed by the squeegee means may then for example be directly fed back to the contact point of the block and the transfer means.

The supply station will then include specific means for ensuring contact between the block and the transfer means.

We claim:

1. A device for impregnating at least one elongate element by transferring a thermostabilizable substance from a station supplying the substance to said element by a transfer means, which comprises means for moving said element longitudinally in front of said transfer means, said transfer means including a mobile surface passing through said station and then in front of said element, means for depositing said substance on said surface at the level of said station while being transferred at least partially onto said at least one element in an impregnation zone in the vicinity of said element, said transfer means comprising first thermoregulation means for controlling the temperature of said surface at the level of the impregnation zone to be substantially higher than that of the substance retained in said supply station; and said supply station comprising second thermoregulation means for controlling the temperature of said substance in said station to be substantially less than the temperature of the surface at the level of the impregnation zone; and a squeegee means adapted for removing from said surface the substance not transferred by said element, said squeegee means being situated upstream of said supply station.

2. The device as claimed in claim 1, comprising a dosing element placed downstream of said supply station, said dosing element being adapted so as to produce, on the surface, a layer of substance which is uniform and adjusted in thickness.

3. A device for impregnating at least one elongate element by transferring a thermostabilizable substance from a station supplying the substance to said element by a transfer means, which comprises means for moving said element longitudinally in front of said transfer means, said transfer means including a mobile surface passing through said station and then in front of said element, means for depositing said substance on said mobile surface at the level of said station while being transferred at least partially onto said at least one element in an impregnation zone in the vicinity of said element, said transfer means comprising first thermoregulation means for controlling the temperature of said surface at the level of the impregnation zone to be substantially higher than that of the substance retained in said supply station; and said supply station comprising second thermoregulation means for controlling the temperature of said substance in said station to be substantially less than the temperature of the surface at the level of the impregnation zone; and means for separating said elongate element from said transfer means and said transfer means including safety drive means adapted for moving said transfer means once the separation means have been brought into action.

4. The device as claimed in claim 3 wherein said thermostabilizable substance is a thermosetting resin.

5. A device for impregnating at least one elongate element by transferring a thermostabilizable substance from a station supplying the substance to said element by a transfer means, which comprises means for moving said element longitudinally in front of said transfer means, said transfer means including a mobile surface passing through said station and then in front of said element, means for depositing said substance on said mobile surface at the level of said station while being transferred at least partially onto said at least one element in an impregnation zone in the vicinity of said element, said transfer means comprising first thermoregulation means for controlling the temperature of said surface at the level of the impregnation zone to be substantially higher than that of the substance retained in said supply station; and said supply station comprising second thermoregulation means for controlling the temperature of said substance in said station to be substantially less than the temperature of the surface at the level of the impregnation zone; said supply station comprising a tank in which said substance is situated and said transfer means being arranged to move said mobile surface into said tank.

6. A device for impregnating at least one elongate element by transferring a thermostabilizable substance from a station supplying the substance to said element by a transfer means, which comprises means for moving said element longitudinally in front of said transfer means, said transfer means including a mobile surface passing through said station and then in front of said element, means for depositing said substance on said mobile surface at the level of said station while being transferred at least partially onto said at least one element in an impregnation zone in the vicinity of said element, said transfer means comprising first thermoregulation means for controlling the temperature of said surface at the level of the impregnation zone to be substantially higher than that of the substance retained in said supply station; and said supply station comprising second thermoregulation means for controlling the temperature of said substance in said station to be substantially less than the temperature of the surface at the level of the impregnation zone; said supply station comprising a tank in which said substance is contained, and a circulating member adapted for picking up said substance situated in said tank, conveying the substance towards said transfer means and coating the transfer means therewith.

7. The device as claimed in claim 1, including spacing means adapted for spacing said transfer means away from said supply station.

* * * * *